US011009028B2

(12) United States Patent
Kabasawa

(10) Patent No.: US 11,009,028 B2
(45) Date of Patent: May 18, 2021

(54) VACUUM PUMP AND STATOR DISK TO BE INSTALLED IN VACUUM PUMP

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 16/335,021

(22) PCT Filed: Aug. 29, 2017

(86) PCT No.: PCT/JP2017/030977
§ 371 (c)(1),
(2) Date: Mar. 20, 2019

(87) PCT Pub. No.: WO2018/061577
PCT Pub. Date: Apr. 5, 2018

(65) Prior Publication Data

US 2019/0249676 A1 Aug. 15, 2019

(30) Foreign Application Priority Data

Sep. 27, 2016 (JP) ..... JP2016-188362

(51) Int. Cl.
*F04D 19/04* (2006.01)
*F04D 29/54* (2006.01)
(Continued)

(52) U.S. Cl.
CPC ..... *F04D 19/04* (2013.01); *F04D 29/541* (2013.01); *F04D 17/168* (2013.01); *F04D 25/06* (2013.01);
(Continued)

(58) Field of Classification Search
CPC ..... F04D 19/04; F04D 19/042; F04D 19/044; F04D 19/046; F04D 19/048; F04D 29/541; F04D 29/542; F04D 17/168
See application file for complete search history.

(56) References Cited

U.S. PATENT DOCUMENTS 1,288,360 A * 12/1918 Zaar ..... F01D 5/142 415/193
3,969,039 A * 7/1976 Shoulders ..... F04D 19/046 417/244
(Continued)

FOREIGN PATENT DOCUMENTS

| | | |
|---|---|---|
| JP | 60188892 | 12/1985 |
| JP | 2002285988 A | 10/2002 |
| WO | 2009028099 A1 | 3/2009 |

OTHER PUBLICATIONS

PCT International Search Report dated Nov. 21, 2017 for corresponding PCT Application No. PCT/JP2017/030977.
(Continued)

*Primary Examiner* — Brian P Wolcott
*Assistant Examiner* — Behnoush Hashighian
(74) *Attorney, Agent, or Firm* — Theodore M. Magee; Westman, Champlin & Koehler, P.A.

(57) ABSTRACT

In a vacuum pump, the proportion of hole portions at a distal end (outer peripheral side/outer peripheral portion) of a stator disc is locally increased. More specifically, hole portions of substantially the same size are provided in parallel from the inner peripheral side to the outer peripheral side of the stator disc, and the number of hole portions provided in the outermost row is set to be larger than the number of hole portions provided in an inner row. Hole portions of substantially the same size are provided in parallel from the inner peripheral side to the outer peripheral side of the stator disc, and some of hole portions provided
(Continued)

in the outermost row are integrated to be a single hole portion. T shaped hole portions are provided in the stator disc. L shaped hole portions are provided in the stator disc.

9 Claims, 9 Drawing Sheets

(51) Int. Cl.
*F04D 25/06* (2006.01)
*F04D 17/16* (2006.01)

(52) U.S. Cl.
CPC ..... *F05B 2240/12* (2013.01); *F05B 2250/19* (2013.01)

(56) References Cited

U.S. PATENT DOCUMENTS 4,309,143 A * 1/1982 Klatt ..... F04D 19/042 29/889.23
5,158,426 A * 10/1992 Casaro ..... F04D 19/042 403/340
5,358,373 A * 10/1994 Hablanian ..... F04D 17/168 415/194
7,481,625 B2 * 1/2009 Kim ..... F01D 5/048 416/185
7,824,153 B2 * 11/2010 Akimoto ..... F04D 29/542 415/191
8,257,033 B2 * 9/2012 Oishi ..... F04D 29/542 29/889.4
9,879,553 B2 * 1/2018 Shi ..... F04D 19/042
10,161,403 B2 * 12/2018 Sumimoto ..... F04D 29/542
10,337,517 B2 * 7/2019 Schofield ..... F04D 19/04
2006/0280595 A1 * 12/2006 Stoll ..... F04D 29/542 415/90
2015/0037137 A1 * 2/2015 Schofield ..... F04D 29/185 415/90

OTHER PUBLICATIONS

PCT International Written Opinion dated Nov. 21, 2019 for corresponding PCT Application No. PCT/JP2017/030977.

* cited by examiner

VACUUM PUMP AND STATOR DISK TO BE INSTALLED IN VACUUM PUMP

CROSS-REFERENCE OF RELATED APPLICATION

This application is a Section 371 National Stage Application of International Application No. PCT/JP2017/030977, filed Aug. 29, 2017, which is incorporated by reference in its entirety and published as WO 2018/061577 A1 on Apr. 5, 2018 and which claims priority of Japanese Application No. 2016-188362, filed Sep. 27, 2016.

BACKGROUND

The present invention relates to a vacuum pump and a stator disc to be installed in the vacuum pump.

More specifically, the present invention relates to a vacuum pump that reduces occurrence of a locally high-pressure part in a spiral plate in a vacuum pump provided with the spiral plate, and a stator disc to be installed in the vacuum pump.

In a vacuum pump for performing vacuum exhaust in a vacuum chamber provided therein, a gas transfer mechanism that is a structure configured by a rotating portion and a stator portion for exhibiting an exhaust function is housed. Examples of the gas transfer mechanism include the one configured to compress gas by interaction between a spiral plate provided on the rotating portion and a stator disc provided on the stator portion.

Japanese Translation of PCT Application No. 2015-505012 discloses a technology in which a spiral plate (such as a spiral blade 30) is disposed on the side surface of a rotating cylinder in a vacuum pump, and a stator disc (such as an intersecting perforated element 14) provided with an array of hole portions (such as perforations 38) is provided in at least one slot 40 (corresponding to a configuration called "slit" in the description of the present application) provided in the spiral plate.

FIG. 9 is a diagram for describing a stator disc 1010 as an example of the stator disc provided in a conventional vacuum pump as described above. As illustrated in FIG. 9, in a conventional vacuum pump, exhaust action is caused by interaction (A) between a spiral plate and a stator disc 1010 in which hole portions 1020 are provided in a staggered arrangement and interaction (B) between the spiral plate and a casing.

As the proportion of the hole portions 1020 (a proportion by which the hole portions are occupied in the stator disc) becomes larger, compressed gas passes through a gas transfer mechanism more easily but the exhaust action becomes smaller. Thus, the proportion of the hole portions 1020 is set depending on pressure of gas to be exhausted (for example, the sizes of the holes are designed to be gradually larger from the inner peripheral side to the outer peripheral side).

The discussion above is merely provided for general background information and is not intended to be used as an aid in determining the scope of the claimed subject matter. The claimed subject matter is not limited to implementations that solve any or all disadvantages noted in the background.

SUMMARY

In the vacuum pump having such a structure, however, the action of compressing gas is significantly strong particularly in the vicinity of the distal end (outer peripheral side) of the spiral plate where both the above-mentioned interactions (A) and (B) occur simultaneously.

As a result, a part with high pressure (such as an upper part of the slit in the stator disc) is locally present in the vicinity of the distal end of the spiral plate.

Accordingly, there is a possibility that reaction products produced when the gas exceeds vapor pressure to be liquefied or solidified may be deposited in the vacuum pump.

It is an object of the present invention to provide a vacuum pump that reduces occurrence of a locally high-pressure part in a spiral plate in a vacuum pump provided with the spiral plate, and a stator disc to be installed in the vacuum pump.

An invention of the present application according to claim 1 provides a vacuum pump, including: a housing having an inlet port and an outlet port formed thereon: a rotating shaft enclosed in the housing and rotatably supported; a spiral plate provided with at least one slit and provided on an outer peripheral surface of the rotating shaft or a rotating cylindrical body provided on the rotating shaft in a spiral manner: a stator disc disposed in the slit in the spiral plate with a predetermined interval from the slit and having hole portions passing therethrough; a spacer portion fixing the stator disc; and a vacuum exhaust mechanism configured to transfer gas sucked from the inlet port toward the outlet port by interaction between the spiral plate and the stator disc, in which the hole portions are provided in at least an outer peripheral region and an inner peripheral region of the stator disc, and an aperture ratio in the outer peripheral region is higher than an aperture ratio in the inner peripheral region.

An invention of the present application according to claim 2 provides the vacuum pump according to claim 1 in which the hole portions are circular holes having substantially the same diameter shape, and a larger number of the circular holes are provided in parallel in a predetermined region of the stator disc on an outer peripheral side than a number of the circular holes in a predetermined region of the stator disc on an inner peripheral side around a virtual center of the stator disc such that an aperture ratio in the stator disc on the outer peripheral side is higher than an aperture ratio in the stator disc on the inner peripheral side.

An invention of the present application according to claim 3 provides the vacuum pump according to claim 1 in which the hole portions includes circular holes having substantially the same diameter shape and a long hole having an elongated shape, and the circular holes are provided in a predetermined region of the stator disc on an inner peripheral side and the long hole is provided in a predetermined region of the stator disc on an outer peripheral side in parallel in a radius direction such that an aperture ratio in the stator disc on the outer peripheral side is higher than an aperture ratio in the stator disc on the inner peripheral side.

An invention of the present application according to claim 4 provides the vacuum pump according to claim 1 in which the hole portions includes T-shaped holes each formed by linking an outer peripheral long hole having an elongated shape extending along a circumferential direction on an outer peripheral side of the stator disc and an inner peripheral long hole having an elongated shape extending along a radius direction on an inner peripheral side of the outer peripheral long hole so as to form a substantially T-shape, and the T-shaped holes are arranged in the stator disc in parallel in the circumferential direction such that an aperture ratio in the stator disc on the outer peripheral side is higher than an aperture ratio in the stator disc on the inner peripheral side.

An invention of the present application according to claim 5 provides the vacuum pump according to claim 1 in which the hole portions are L-shaped holes each formed by linking an outer peripheral long hole having an elongated shape extending along a circumferential direction on an outer peripheral side of the stator disc and an inner peripheral long hole having an elongated shape extending along a radius direction on an inner peripheral side of the outer peripheral long hole so as to form a substantially L-shape, and the L-shaped holes are arranged in the stator disc in parallel in the circumferential direction such that an aperture ratio in the stator disc on the outer peripheral side is higher than an aperture ratio in the stator disc on the inner peripheral side.

An invention of the present application according to claim 6 provides the vacuum pump according to claim 5 in which the inner peripheral long hole has a predetermined inclination angle with respect to the radius direction of the stator disc.

An invention of the present application according to claim 7 provides the vacuum pump according to claim 6 in which the inclination angle is an angle determined such that a center of an inner peripheral solid portion surrounded by adjacent ones of the inner peripheral long holes and a center of an outer peripheral solid portion surrounded by adjacent ones of the outer peripheral long holes are aligned on a virtual straight line in the radius direction of the stator disc without the hole portion interposed therebetween.

An invention of the present application according to claim 8 provides the vacuum pump according to any one of claims 1 to 7 in which the stator disc is divided in a diameter direction at a position at which at least one of the hole portions disposed on an inner peripheral side is divided, and a gap is formed in a divided part of the divided hole portion on the inner peripheral side.

An invention of the present application according to claim 9 provides the vacuum pump according to any one of claims 1 to 8 in which a path of heat serving as a shortest route from an inner peripheral side to an outer peripheral side of the stator disc is formed at at least one location on the stator disc that does not include the hole portion.

An invention of the present application according to claim 10 provides a stator disc to be provided in the vacuum pump according to any one of claims 1 to 9.

According to the present invention, occurrence of a locally high-pressure part in the vicinity of the distal end of the spiral plate provided in the vacuum pump can be reduced. Consequently, a risk that reaction products of gas liquefied or solidified due to high pressure are deposited can be reduced, and hence maintenance cycle of the vacuum pump can be extended.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF E PREFERRED EMBODIMENT

(i) Outline of Embodiment

In a vacuum pump according to an embodiment of the present invention, a plurality of hole portions are formed in a stator disc, and the proportion of holes at a distal end (outer peripheral side; outer peripheral portion) of the stator disc is locally increased (high). In other words, an aperture ratio on the outer peripheral side is increased.

More specifically, the vacuum pump has any one of the following configurations (1) to (4).

(1) Hole portions (substantially circular holes) of the same size are provided in a wave pattern from the inner peripheral side to the outer peripheral side of the stator disc, and the number of hole portions provided in the outermost row is set to be larger than the number of hole portions provided in an inner row.

(2) Hole portions of the same size are provided in a wave pattern from the inner peripheral side to the outer peripheral side of the stator disc, and some of hole portions provided in the outermost row are integrated to be a single hole portion (long hole).

(3) T-shaped hole portions are provided in the stator disc.

(4) L-shaped hole portions are provided in the stator disc.

The above-mentioned configurations prevent a part with high pressure from being easily present in the vicinity of the distal end of the spiral plate, and hence the risk that reaction products of liquefied or solidified gas are deposited in the vacuum pump can be reduced.

(ii) Details of Embodiment

Exemplary embodiments of the present invention are described in detail below with reference to FIG. 1 to FIG. 8.

Configuration of Vacuum Pump 1

Figure 1:
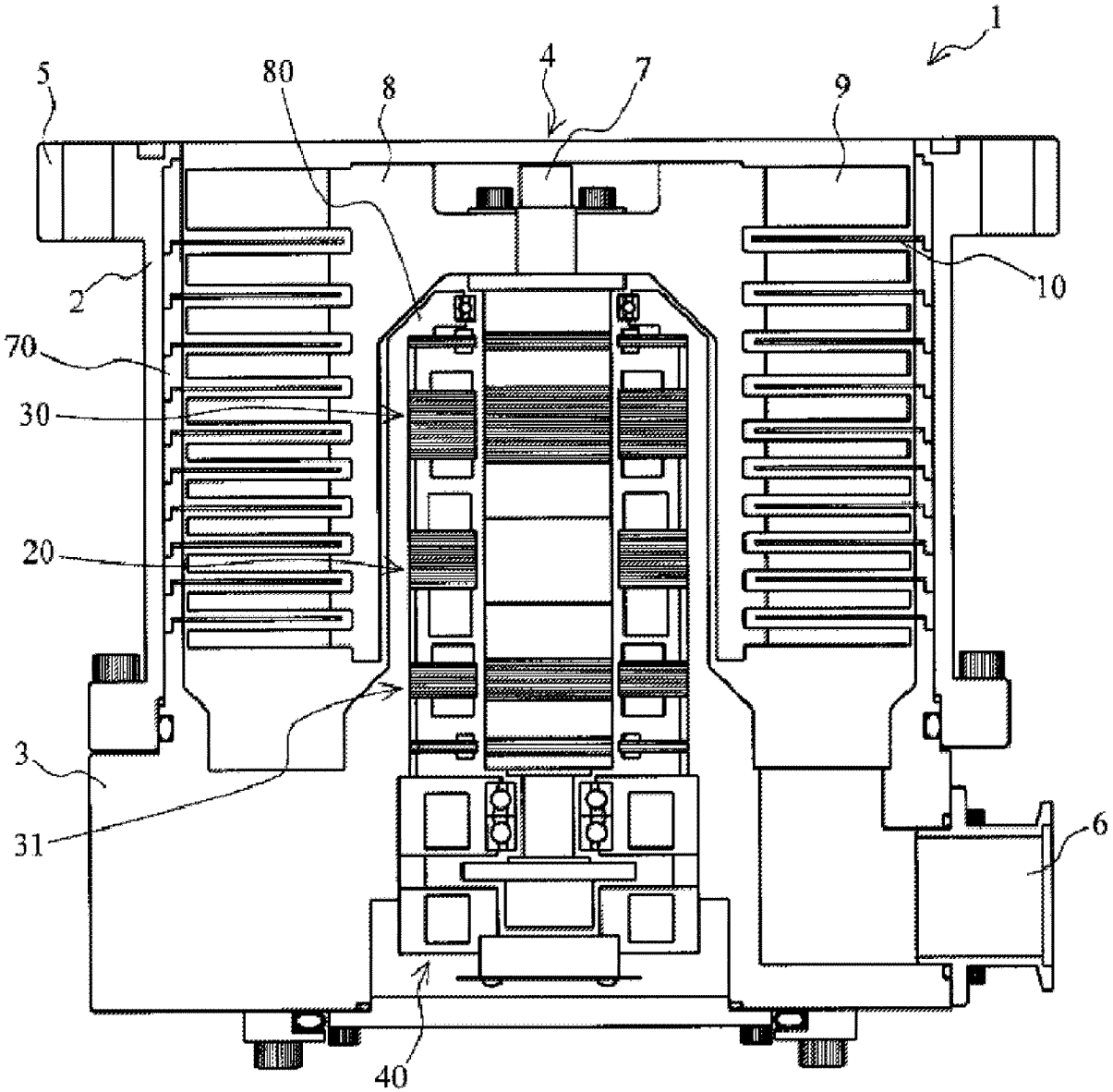
FIG. 1 is a diagram illustrating a schematic configuration example of a vacuum pump according to an embodiment of the present invention.

FIG. 1 is a diagram illustrating a schematic configuration example of a vacuum pump 1 according to an embodiment of the present invention, and illustrates a cross-sectional view in an axial direction of the vacuum pump 1.

Note that, in the embodiment of the present invention, for the sake of convenience, the diameter direction of a rotor blade is referred to as "radial (diameter/radius) direction", and a direction perpendicular to the diameter direction of the rotor blade is referred to as "axial line direction (or axial direction)".

A casing (outer cylinder) 2 forming a housing of the vacuum pump 1 has a substantially cylindrical shape, and constitutes a case of the vacuum pump 1 together with a base 3 provided at a lower part (on outlet port 6 side) of the casing 2. A gas transfer mechanism as a structure for causing the vacuum pump 1 to exhibit an exhaust function is housed inside the case.

In the present embodiment, the gas transfer mechanism roughly includes a rotating portion (a rotor portion) rotatably supported and a stator portion fixed to the case.

Although not illustrated, a control device for controlling the operation of the vacuum pump 1 is connected outside the housing of the vacuum pump 1 through a dedicated line.

An inlet port 4 for introducing gas into the vacuum pump 1 is formed at an end of the casing 2. A flange portion 5 that protrudes to the outer peripheral side is formed on an end surface of the casing 2 on the inlet port 4 side.

An outlet port 6 for exhausting gas from the vacuum pump 1 is formed in the base 3.

The rotating portion in the gas transfer mechanism includes a shaft 7 as a rotating shaft, a rotor 8 provided on the shaft 7, and a plurality of spiral plates 9 provided on the rotor 8.

Each spiral plate 9 is formed by a spiral disc member that extends radially with respect to the axial line of the shaft 7 and extends so as to a spiral channel.

A motor portion 20 for rotating the shaft 7 at high speed is provided in the middle of the shaft 7 in the axial direction, and is enclosed in a stator column 80.

In the stator column 80, radial magnetic bearing devices 30 and 31 for supporting the shaft 7 in the radial direction in a non-contact manner are provided on the shaft 7 on the inlet port 4 side and the outlet port 6 side with respect to the motor portion 20. An axial magnetic bearing device 40 for supporting the shaft 7 in the axial direction in a non-contact manner is provided on a lower end of the shaft 7.

The stator portion in the gas transfer mechanism is formed on the inner peripheral side of the case (casing 2).

The stator portion is provided with stator discs 10 that are fixed by a spacer 70 having a cylindrical shape so as to the isolated from each other.

The stator disc 10 is a plate-shaped member having a disc shape that radially extends perpendicularly to the axial line of the shaft 7. In the present embodiment, semicircular (imperfect circular) members are bonded to form a circular member, and the circular members are provided in a plurality of stages in the axial direction on the inner peripheral side of the casing 2 so as to be staggered with the spiral plates 9.

Note that the number of stages is determined such that desired numbers of the stator discs 10 and (or) the spiral plates 9 necessary for satisfying discharge performance (exhaust performance) required for the vacuum pump 1 are provided.

In the present embodiment, hole portions (aperture portions) are provided in the stator disc 10. Note that, in the following description in the present embodiment, a hole passing through the stator disc 10 is referred to as "hole portion", and details of the hole portion are described later.

The spacer 70 is a fixation member having a cylindrical shape, and the stator discs 10 in the respective stages are fixed by the spacer 70 while being isolated from each other.

With the configuration described above, the vacuum pump 1 performs vacuum exhaust treatment in a vacuum chamber (not shown) provided in the vacuum pump 1.

Example 1

The stator disc 10 provided in the above-mentioned vacuum pump 1 is described with reference to FIG. 2.

Figure 2:
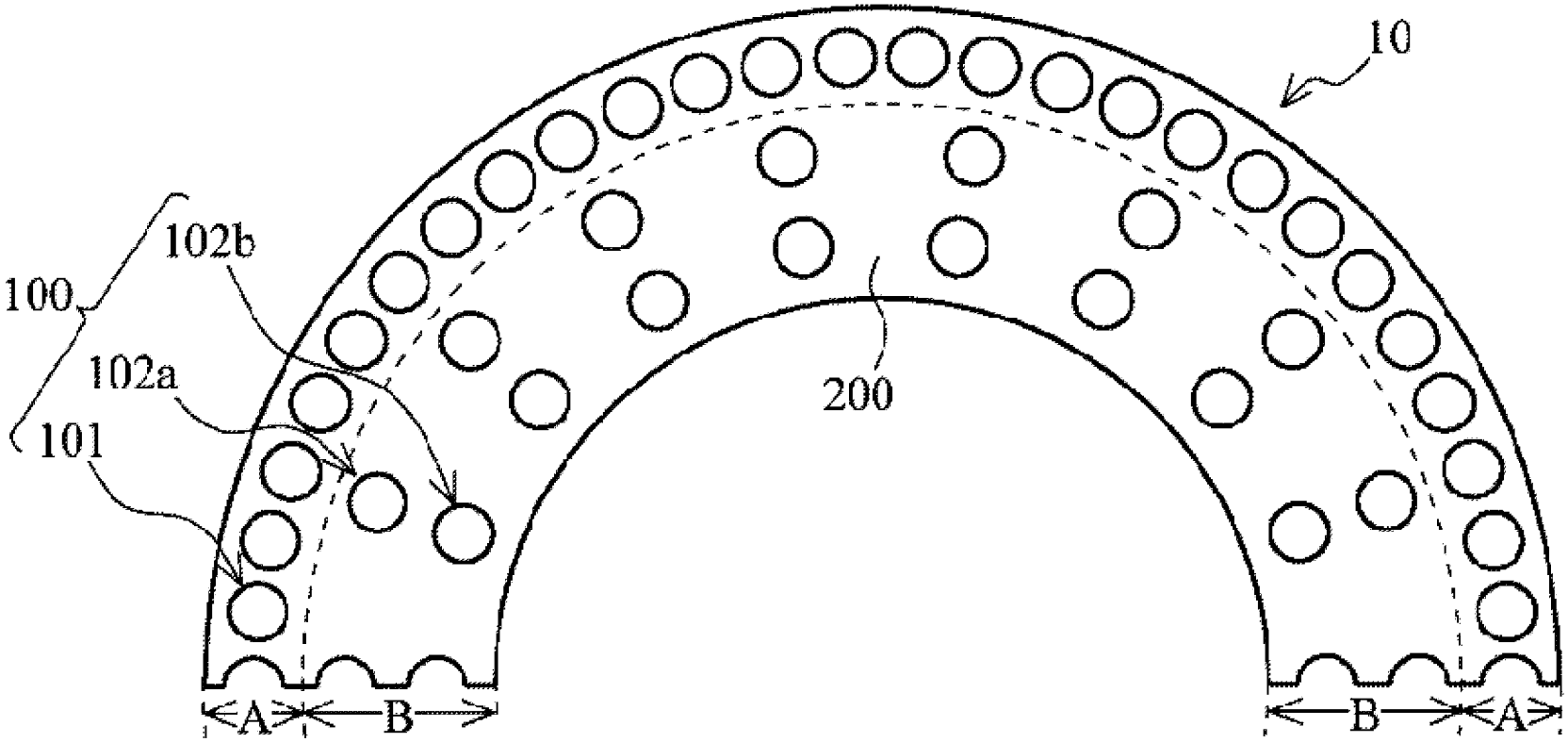
FIG. 2 is a diagram for describing a stator disc according to the embodiment (Example 1) of the present invention.

FIG. 2 is a diagram for describing a stator disc 10 according to Example 1 of the present embodiment.

In Example 1 of the embodiment described below, a circumferential surface in a solid portion 200 of the stator disc 10 on the outer peripheral side is referred to as "area A", and a circumferential surface in the solid portion 200 of the stator disc 10 on the inner peripheral side is referred to as "area B". The same applies to the following Example 2 to Example 6.

Note that, in the present embodiment (Example 1 to Example 6), the ratio in radial cross-sections between the area A and the area B is 1:2, but the ratio is not limited thereto. The ratio can be appropriately set as long as the radial cross-section in the area A is smaller than that in the area B.

As illustrated in FIG. 2, the stator disc 10 has hole portions 100 having substantially the same size and being substantially circular. Note that a solid portion of the stator disc 10 where no hole portion 100 is formed is referred to as "solid portion 200".

The hole portion 100 formed on the stator disc 10 includes an outer peripheral hole portion 101 provided in the area A on the outermost side (outer periphery), and an inner peripheral hole portion 102*a* and an inner peripheral hole portion 102*b* provided in the area B on the inner side (inner periphery). Note that the inner peripheral hole portion 102*a* and the inner peripheral hole portion 102*b* are referred to as "inner peripheral hole portions 102" unless otherwise distinguished.

More specifically, a plurality of hole portions 100 are arranged in parallel around a virtual center of the stator disc 10 from the inner peripheral side to the outer peripheral side of the stator disc 10, and a larger number of the hole portions 100 are disposed in the area A than the number of the hole portions 100 in the area B. In other words, the arrangement of the hole portions 100 is not staggered arrangement.

This configuration can abruptly (locally) increase the proportion of the hole portions 100 with respect to the solid portion 200 on the radially outer side (area A) of the stator disc 10. Specifically, the aperture ratio on the outer peripheral side can be set to be higher than the aperture ratio on the inner peripheral side. In other words, only the aperture ratio on the outer peripheral side of the stator disc 10 can be increased.

Note that the ratio between the aperture ratio on the inner peripheral side and the aperture ratio on the outer peripheral side are 1:3 in Example 1, but the ratio therebetween is not limited thereto. The ratio therebetween may desirably be about 1:2 to 1:9.

With the above-mentioned configuration in Example 1, the aperture ratio in the stator disc 10 on the outer peripheral side can be set to be larger than the aperture ratio in the stator disc 10 on the inner peripheral side, and hence a phenomenon that the vicinity of the distal end of the spiral plate 9 on the radially outer side is locally increased in pressure when the vacuum pump 1 provided with the stator disc 10 is operated can be prevented from easily occurring.

The hole portions 100 are parallel in the radius direction, and hence a path of heat in the solid portion 200 has the shortest distance. Consequently, heat accumulated in the stator disc 10 can be easily released to the outside through the spacer 70 while maintaining the strength of the stator disc 10.

Example 2

Example 2, which is a modified example of the stator disc 10 provided in the above-mentioned vacuum pump 1, is described with reference to FIG. 3.

Figure 3:
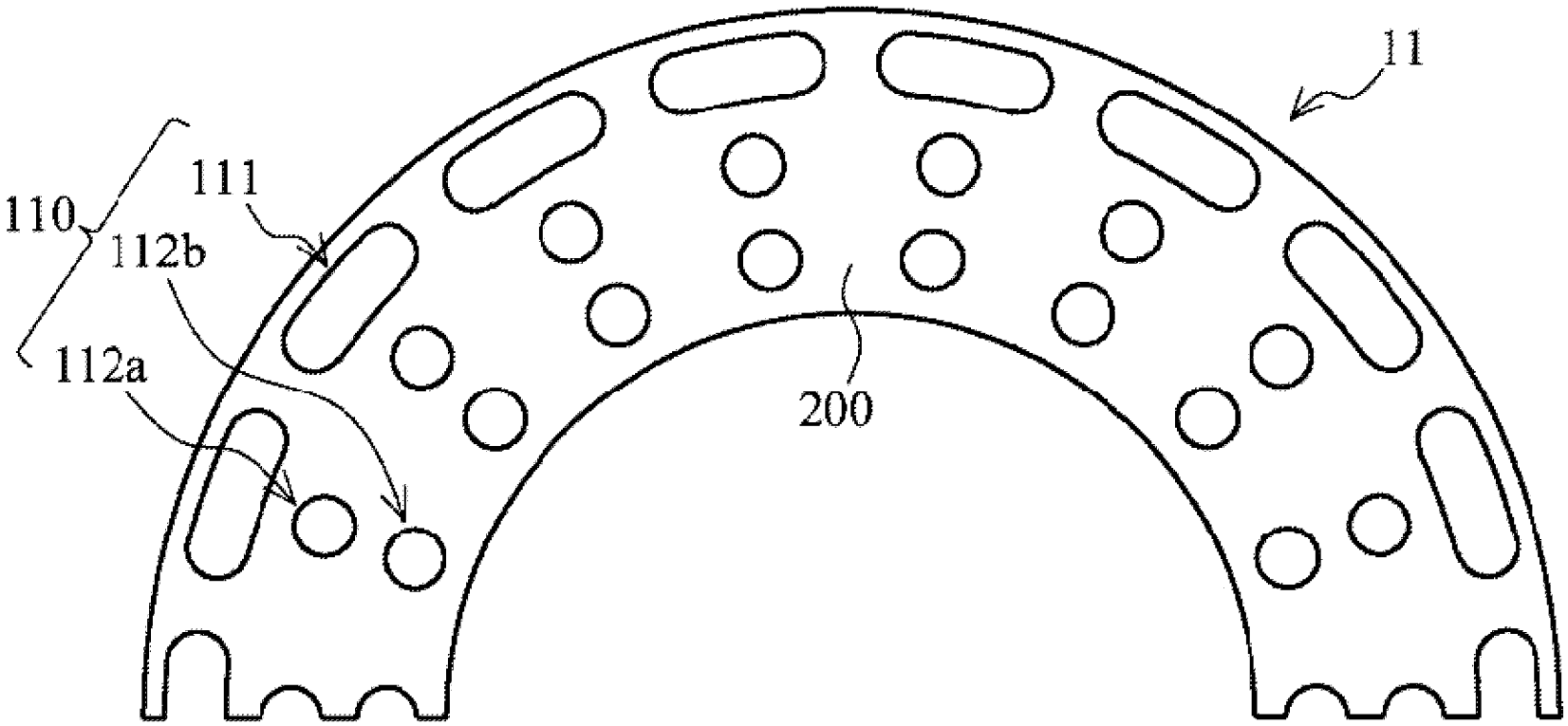
FIG. 3 is a diagram for describing a stator disc according to e embodiment (Example 2) of the present invention.

FIG. 3 is a diagram for describing a stator disc 11 according to Example 2 of the present embodiment.

As illustrated in FIG. 3, the stator disc 11 has a hole portion 110 formed by a circular hole portion having a substantially circular shape corresponding to the hole portion 100 in Example 1, and a long hole portion having an elongated shape formed by integrating some circular hole portions as a single hole portion.

More specifically, an outer peripheral hole portion 111, which is a long hole having a major axis and a minor axis or a hole having an elliptical shape, is formed on the stator disc 11 in an area A on the outermost peripheral side. In an area B on the inner peripheral side of the area A, an inner peripheral hole portion 112*a* and an inner peripheral hole portion 112*b* having substantially the same size and being substantially circular are formed. Note that the inner peripheral hole portion 112*a* and the inner peripheral hole portion 112*b* are referred to as "inner peripheral hole portion 112" unless otherwise distinguished.

A plurality of the hole portions 110 are disposed on the stator disc 11 in parallel in a wave pattern around a virtual center of the stator disc 11 in the order of the inner peripheral hole portion 112 and the outer peripheral hole portion 111 from the inner peripheral side to the outer peripheral side.

The configuration having the outer peripheral hole portion 111 enables the proportion of the hole portions 110 with respect to the solid portion 200 to be locally increased on the radially outer side (area A) of the stator disc 11. In other words, the aperture ratio on the outer peripheral side can be abruptly increased as compared with the aperture ratio on the inner peripheral side.

With the above-mentioned configuration in Example 2, the aperture ratio in the stator disc 11 on the outer peripheral side can be locally increased, and hence a phenomenon that the vicinity of the distal end of the spiral plate 9 on the radially outer side is locally increased in pressure when the vacuum pump 1 provided with the stator disc 11 is operated can be prevented from easily occurring.

The hole portions 110 are disposed in parallel in the radius direction in the order of the inner peripheral hole portion 112 and the outer peripheral hole portion 111 from the inner peripheral side of the stator disc 11, so that the solid portion 200 is continuous in the radius direction, and a path of heat in the solid portion 200 has the shortest distance. Consequently, heat accumulated in the stator disc 11 can be easily released to the outside through the spacer 70 while maintaining the strength of the stator disc 11.

Example 3

Example 3, which is a modified example of the above-mentioned stator disc 11 provided on the vacuum pump 1, is described with reference to FIG. 4.

Figure 4:
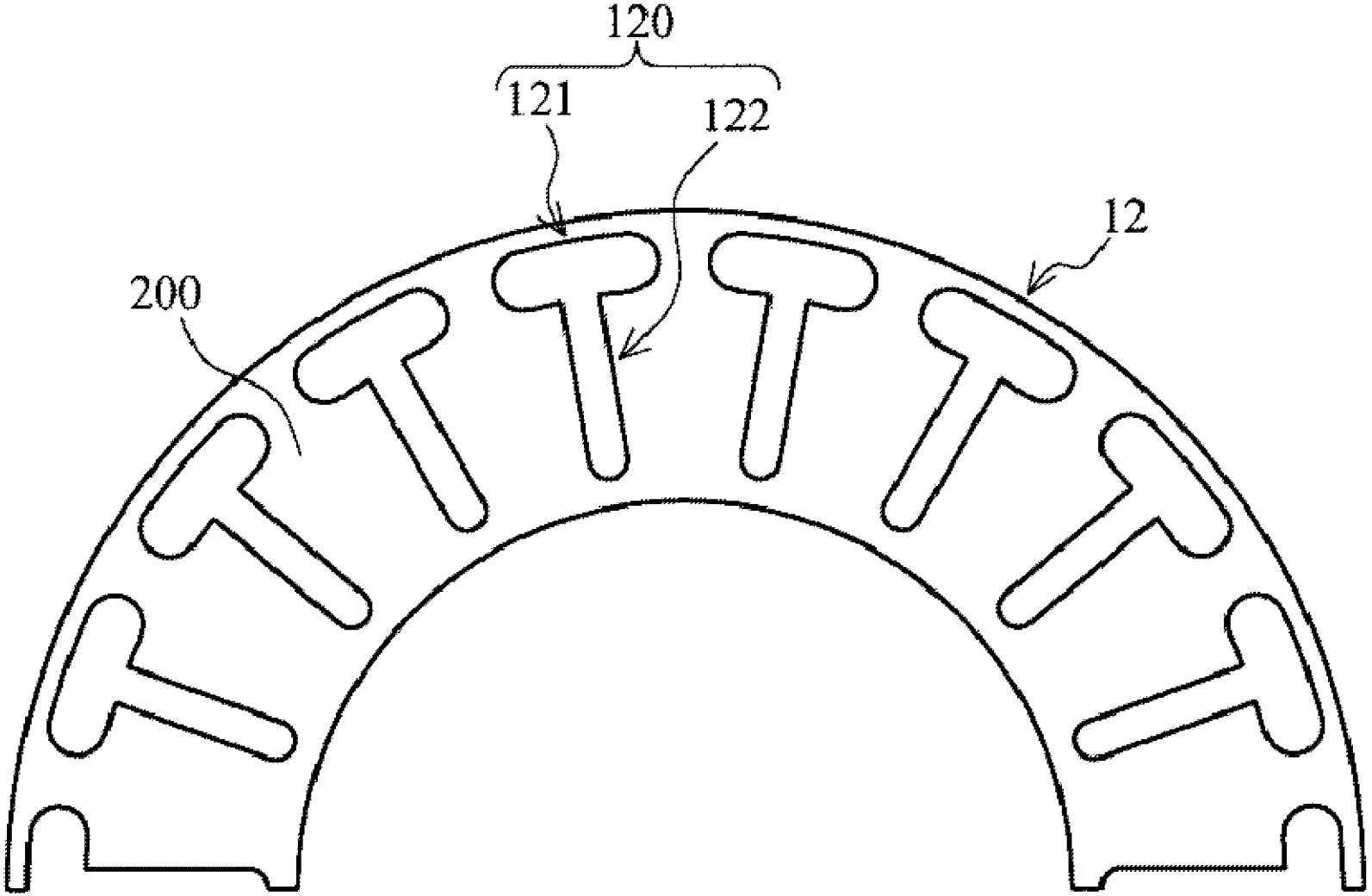
FIG. 4 is a diagram for describing a stator disc according to the embodiment (Example 3) of the present invention.

FIG. 4 is a diagram for describing a stator disc 12 according to Example 3 of the present embodiment.

As illustrated in FIG. 4, the stator disc 12 has a T-shaped hole portion 120 formed by combining (linking) a long hole portion corresponding to the outer peripheral hole portion 111 in Example 2 and a long hole portion formed by linking (coupling) the inner peripheral hole portions 112(*a, b*) in Example 2 in the radius direction so as to form a T-shape.

More specifically, an outer peripheral hole portion 121, which is a long hole or a hole having an elliptical shape having a major axis extending in the outer peripheral direction and a minor axis extending in the radius direction, is formed on the stator disc 12 on the outer peripheral side. An inner peripheral hole portion 122, which is a long hole or a hole having an elliptical shape having a major axis extending in the radius direction, is formed on the inner peripheral side of the outer peripheral hole portion 121. The outer peripheral hole portion 121 and the inner peripheral hole portion 122 are linked at substantially the center part of the outer peripheral hole portion 121 in the major axis direction to form the T-shaped hole portion 120.

The T-shaped hole portion 120 is formed on the stator disc 12 such that the inner peripheral hole portion 122 and the outer peripheral hole portion 121 are provided in this order from the inner peripheral side to the outer peripheral side with a virtual center of the stator disc 12 being the center. A plurality of the T-shaped hole portions 120 are preferably disposed in parallel in the circumferential direction.

The configuration having the T-shaped hole portions 120 enables the stator disc 12 to abruptly increase the proportion of the hole portions to the solid portion 200 on the radially outer side.

With the above-mentioned configuration in Example 3, the aperture ratio in the stator disc 12 on the outer peripheral side can be locally increased, and hence a phenomenon that the vicinity of the distal end of the spiral plate 9 on the radially outer side is locally increased in pressure when the vacuum pump 1 provided with the stator disc 12 is operated can be prevented from easily occurring.

In the T-shaped hole portion 120, the inner peripheral hole portion 122 and the outer peripheral hole portion 121 are disposed in the radius direction in this order from the inner peripheral side of the stator disc 12, and hence the solid portion 200 is continuous in the radius direction, and a path of heat in the solid portion 200 has the shortest distance. Consequently, heat accumulated in the stator disc 12 can be easily released to the outside through the spacer 70 while maintaining the strength of the stator disc 12.

Example 4

A modified example (Example 4) of the stator disc 12 provided on the above-mentioned vacuum pump 1 is described with reference to FIG. 5.

Figure 5:
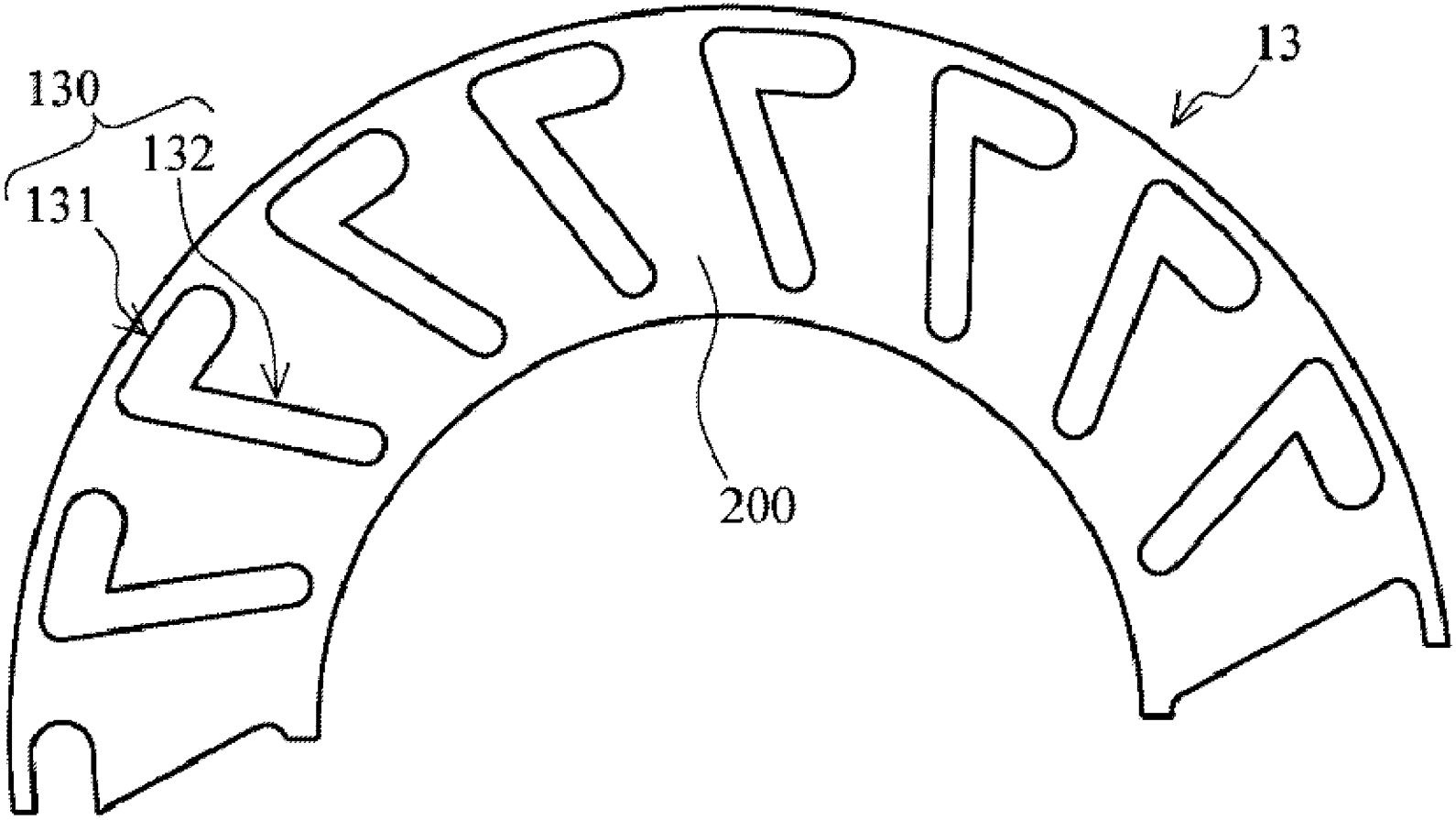
FIG. 5 is a diagram for describing a stator disc according to the embodiment (Example 4) of the present invention.

FIG. 5 is a diagram for describing a stator disc 13 according to Example 4 of the present embodiment.

As illustrated in FIG. 5, the stator disc 13 has an L-shaped hole portion 130 formed by combining two long hole portions that are long holes having a major axis and a minor axis or holes having an elliptical shape corresponding to the outer peripheral hole portion 121 and the inner peripheral hole portion 122 in Example 3 so as to form an L-shape.

More specifically, in the stator disc 13, an outer peripheral hole portion 131, which is a long hole or a hole having an elliptical shape having a major axis extending in the outer peripheral direction and a minor axis extending in the radius direction, is formed on the outer peripheral side. An inner peripheral hole portion 132, which is a long hole or a hole having an elliptical shape having a major axis extending in the radius direction, is formed on the inner peripheral side of the outer peripheral hole portion 131. The outer peripheral hole portion 131 and the inner peripheral hole portion 132 are linked at one of end portion of the outer peripheral hole portion 131 in the major axis direction to form the L-shaped hole portion 130 on the stator disc 13.

In Example 4, it is preferred that the inner peripheral hole portion 132 be disposed obliquely with respect to the radius direction of the stator disc 13. Specifically, the L-shaped hole portion 130 is formed such that the long side direction of the inner peripheral hole portion 132 and the radius direction have a predetermined inclination angle (less than 90 degrees).

The L-shaped hole portion 130 is formed on the stator disc 13 such that the inner peripheral hole portion 132 and the outer peripheral hole portion 131 are provided in this order from the inner peripheral side to the outer peripheral side with a virtual center of the stator disc 13 being the center. A plurality of the U-shaped hole portions 130 are preferably disposed in parallel in the circumferential direction.

The configuration having the L-shaped hole portions 130 enables the stator disc 13 to abruptly increase the proportion of the hole portions to the solid portion 200 on the radially outer side.

The above-mentioned configuration in Example 4 can locally increase the aperture ratio of the stator disc 13 on the outer peripheral side, and hence a phenomenon that the vicinity of the distal end of the spiral plate 9 on the radially outer side is locally increased in pressure when the vacuum pump 1 provided with the stator disc 13 is operated can be prevented from easily occurring.

In the L-shaped hole portion 130, the inner peripheral hole portion 132 and the outer peripheral hole portion 131 are disposed in the radius direction in this order from the inner peripheral side of the stator disc 13, and hence the solid portion 200 is continuous in the radius direction, and a path of heat in the solid portion 200 has the shortest distance. Consequently, heat accumulated in the stator disc 13 can be easily released to the outside through the spacer 70 while maintaining the strength of the stator disc 13.

The inner peripheral hole portion 132 in the L-shaped hole portion 130 is disposed obliquely with respect to the radius direction of the stator disc 13, and hence the timing at which the spiral plate 9 passes the L-shaped hole portion 130 can be shifted between the inner peripheral side and the outer peripheral side (can be prevented from matching). As a result, the possibility of reducing pressure fluctuation increases.

Example 5

Next, Example 5, which is a modified example of the above-mentioned stator disc 13 (Example 4), is described with reference to FIG. 6.

Figure 6:
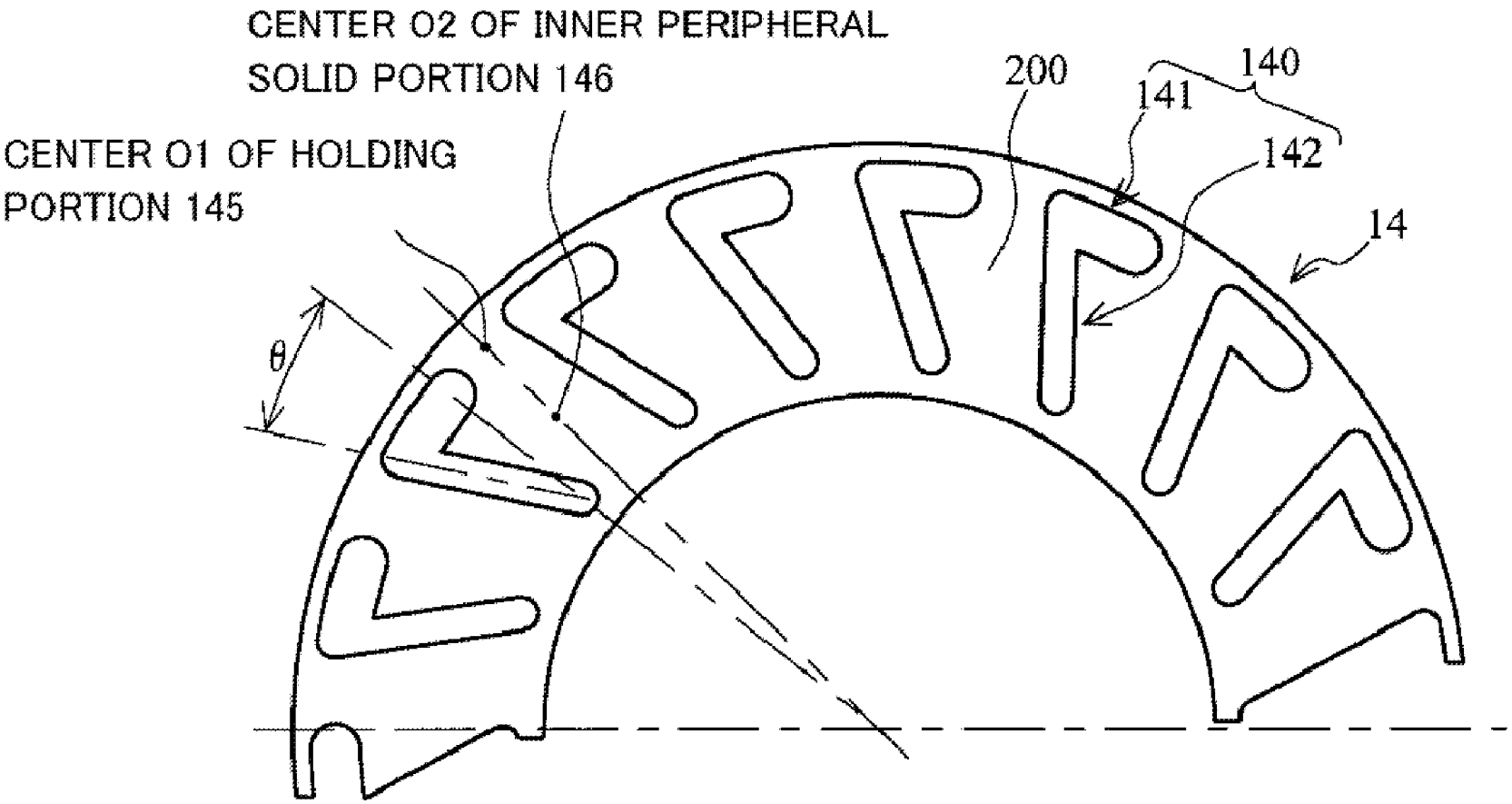
FIG. 6 is a diagram for describing a stator disc according to embodiment (Example 5) of the present invention.

FIG. 6 is a diagram for describing a stator disc 14 according to Example 5 of the present embodiment.

As illustrated in FIG. 6, in the stator disc 14, an L-shaped hole portion 140 having the same basic structure as the configuration of the L-shaped hole portion 130 in Example 4 is formed. Specifically, the L-shaped hole portion 140 has an outer peripheral hole portion 141 on the outer peripheral side and an inner peripheral hole portion 142 on the inner peripheral side of the outer peripheral hole portion 141, in which the outer peripheral hole portion 141 and the inner peripheral hole portion 142 are linked at one of both ends of the outer peripheral hole portion 141 in the major axis direction.

In Example 5, in a solid portion 200 of the stator disc 14, a part surrounded by the inner peripheral hole portions 142 of adjacent U-shaped hole portions 140 is referred to as "inner peripheral solid portion 146". In the solid portion 200 of the stator disc 14, a part surrounded by the outer peripheral hole portions 141 of adjacent L-shaped hole portions 140 is referred to as "holding portion 145".

In the stator disc 14, an inclination angle (inclination angle θ) of the L-shaped hole portion 140 between the long side direction of the inner peripheral hole portion 142 and the radius direction of the stator disc 14 is determined such that a center O2 of the inner peripheral solid portion 146 and a center O1 of the holding portion 145 are aligned on a virtual straight line in the radius direction of the stator disc 14. More specifically, the inclination angle θ is determined by the number of the L-shaped hole portions 140 provided on the stator disc 14, the width of the holding portion 145 in the circumferential direction, and the length of the inner peripheral solid portion 146 in the radius direction.

With the above-mentioned configuration, in the stator disc 14 according to Example 5, a risk that the stator disc 14 is twisted and deformed when load is imposed on the stator disc 14 due to fluctuation in gas load can be reduced in addition to the effect described above in Example 4.

As a result, the risk of contact between the spiral plate 9 and the stator disc 14 can be reduced.

Example 6

Example 6, which is a modified example of the above-mentioned stator discs (10, 11, 12, 13, and 14), is described with reference to FIG. 7. Note that, in FIG. 7, a stator disc 15 in which a T-shaped hole portion 150 (outer peripheral hole portion 151, inner peripheral hole portion 152) corresponding to the T-shaped hole portion 120 in Example 3 is formed is described as an example.

Figure 7:
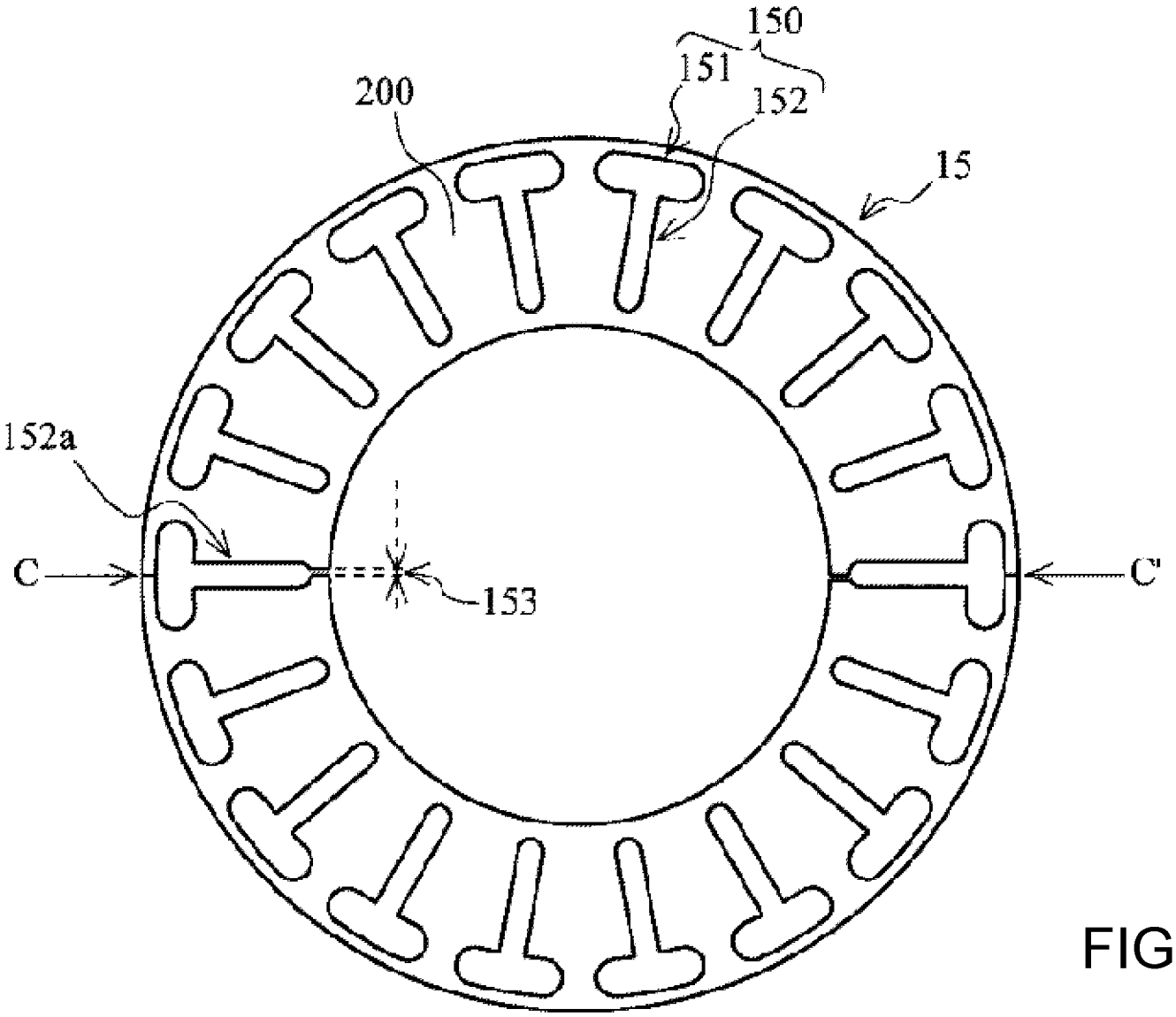
FIG. 7 is a diagram for describing a stator disc according to the embodiment (Example 6) of the present invention.

FIG. 7 is a diagram for describing the stator disc 15 according to Example 6 of the present embodiment.

As illustrated in FIG. 7, in Example 6, the stator disc 15 is divided (cut) into two pieces. Note that the stator disc is divided into two pieces in Example 6 but the number of divisions (or the number of cutting surfaces) is not limited thereto.

The stator disc 15 is divided such that a dividing surface C-C' in the stator disc 15 matches with parts where the T-shaped hole portions 150 are formed. In other words, the dividing surface C-C' is not formed by dividing only solid portion 200 in the stator disc 15.

Any of the T-shaped hole portions 150 in which the dividing surface C-C' of the stator disc 15 is formed has a divided inner peripheral hole portion 152*a* in which a relief 153 as a gap (clearance) is formed.

Note that it is desired that the spacing of the relief 153 be about 1 mm.

The above-mentioned configuration in Example 6 can facilitate the assembly work for providing the stator disc 15 to the vacuum pump 1.

In the stator disc 15, a clearance (relief 153) is provided on the inner peripheral side at the formed dividing surface C-C' (portion where divided portions abut each other), and hence the divided stator discs 15 can be prevented from overlapping each other. Consequently, a problem in that the stator disc 15 is chipped due to the overlapping or collapse of the dividing surfaces can be reduced to extend the maintenance cycle.

Example 7

Figure 8:
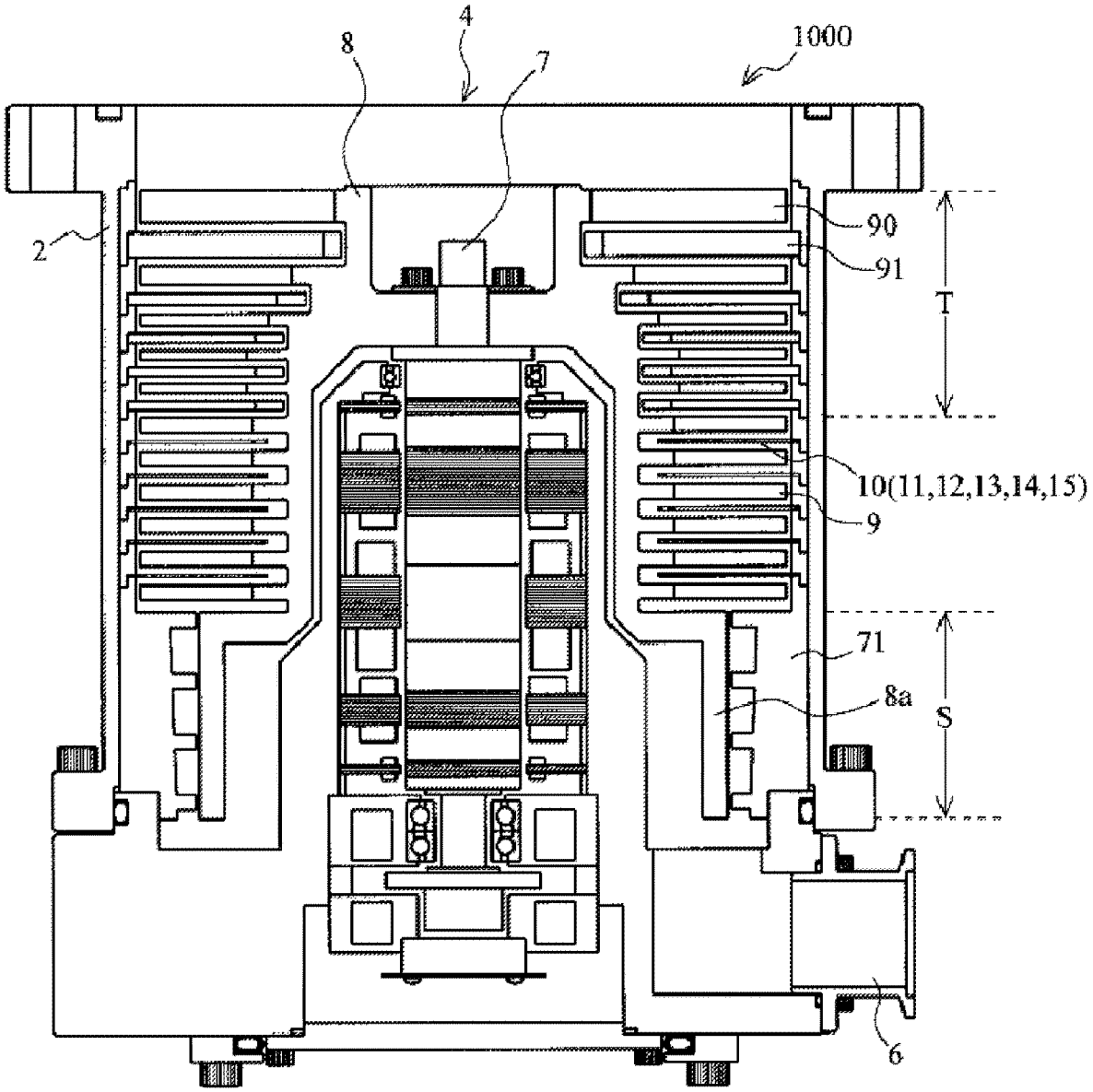
FIG. 8 is a diagram illustrating a schematic configuration example of a composite vacuum pump according to the embodiment (Example 7) of the present invention.
Figure 9:
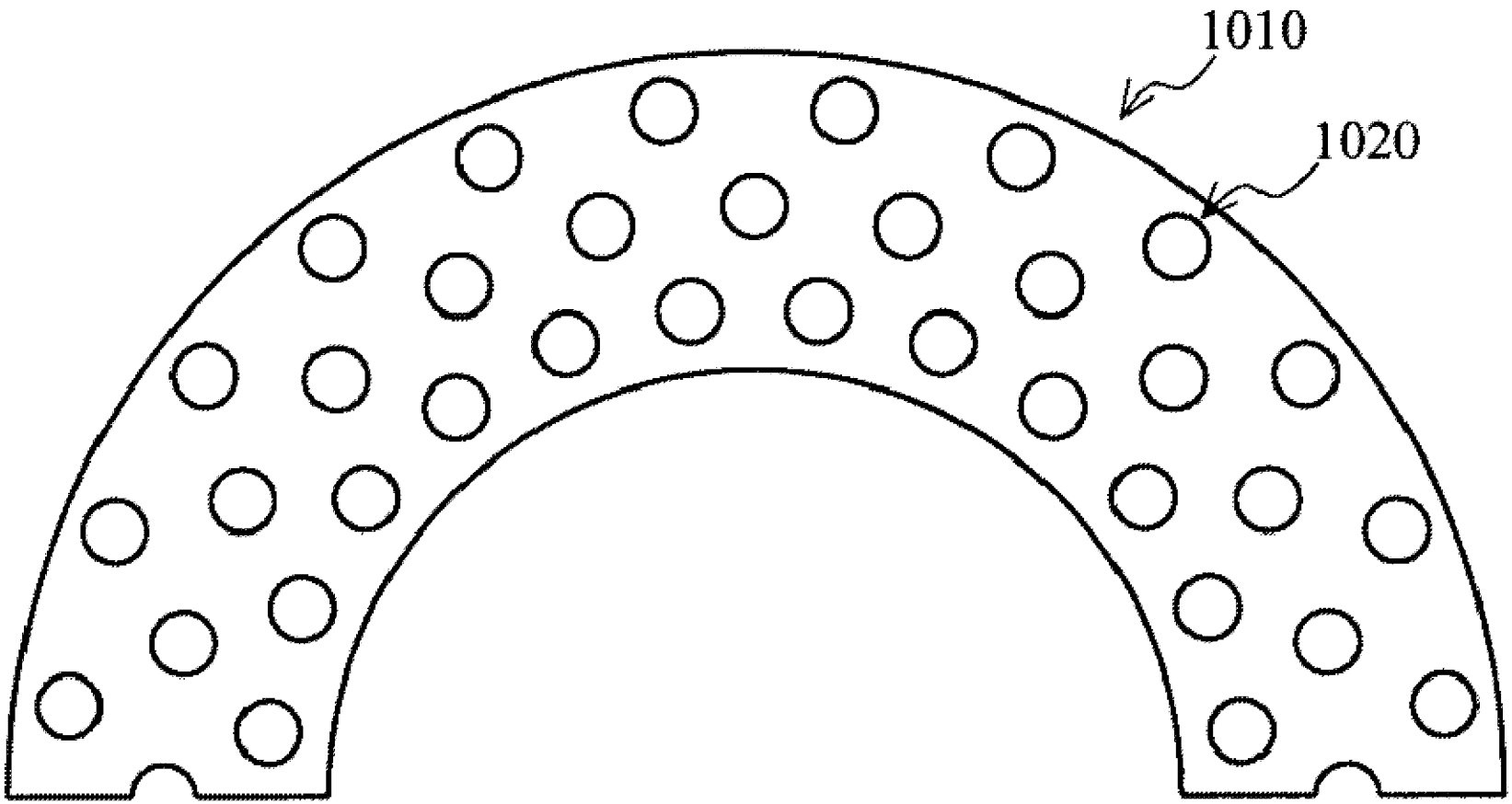
FIG. 9 is a diagram for describing conventional technology.

FIG. 8 is a diagram illustrating a schematic configuration example of a composite vacuum pump 1000 according to Example 7 of the present embodiment.

In the composite vacuum pump 1000 according to Example 7, a turbomolecular pump portion T is provided on the inlet port 4 side, a thread groove pump portion S is provided on the outlet port 6 side, and a mechanism including any one of the stator discs (10, 11, 12, 13, 14, and 15) described above in Example 1 to Example 6 is provided therebetween.

More specifically, the turbomolecular pump portion T includes a plurality of rotor blades 90 and a plurality of stator blades 91 having a blade shape on the inlet port 4 side in the rotor 8. The stator blades 91 are each formed by a blade that is inclined from a place perpendicular to the axial line of the shaft 7 by a predetermined angle and extends toward the shaft 7 from the inner peripheral surface of the casing 2, and are provided in a plurality of stages in the axial direction so as to be staggered with the rotor blades 90.

The thread groove pump portion S includes a rotor cylindrical portion (skirt portion) 8*a* and a thread groove exhaust element 71. The rotor cylindrical portion 8*a* is a cylindrical member having a cylindrical shape coaxial with the rotating axial line of the rotor 8. In the thread groove exhaust element 71, a thread groove (spiral groove) is formed on a surface opposed to the rotor cylindrical portion 8*a*.

The surface of the thread groove exhaust element 71 opposed to the rotor cylindrical portion 8*a* (that is, an inner peripheral surface parallel to the axial line of the vacuum pump 1000) is opposed the outer peripheral surface of the rotor cylindrical portion 8*a* with a predetermined clearance. When the rotor cylindrical portion 8*a* rotates at high speed, gas compressed in the composite vacuum pump 1000 is sent toward the outlet port 6 while being guided by the thread groove when the rotor cylindrical portion 8*a* rotates. In other words, the thread groove serves as a channel for transporting the gas.

In this manner, the surface of the thread groove exhaust element 71 opposed to the rotor cylindrical portion 8*a* is opposed to the rotor cylindrical portion 8*a* with a predetermined clearance, thereby constituting a gas transfer mechanism for transferring gas through the thread groove formed on the axially inner peripheral surface of the thread groove exhaust element 71.

Note that it is preferred the clearance be smaller in order to reduce force that causes the gas to flow reversely to the inlet port 4 side.

The direction of the thread groove formed in the thread groove exhaust element 71 is a direction toward the outlet port 6 when gas is transported within the thread groove in the rotating direction of the rotor 8.

The depth of the thread groove becomes smaller toward the outlet port 6, and the gas transported through the thread groove is compressed more toward the outlet port 6.

With the configuration described above, the composite vacuum pump 1000 can perform vacuum exhaust treatment in a vacuum chamber (not shown) provided in the vacuum pump 1000.

With the configuration of the composite vacuum pump 1000, gas compressed in the turbomolecular pump portion T is next compressed in a part including any one of the stator discs (10, 11, 12, 13, 14, and 15) in the present embodiment, and is further compressed in the thread groove pump portion S. Consequently, vacuum performance can be further enhanced.

The above-mentioned configuration, in the present embodiment, can reduce occurrence of a locally high-pressure part in the vicinity of the distal end (on radially outer side) of the spiral plate 9 provided in the vacuum pump 1 (1000). Consequently, a risk that reaction products of gas liquefied or solidified due to high pressure are deposited can be reduced, and hence maintenance cycle of the vacuum pump 1 (1000) can be extended.

Note that the embodiment and the modified examples of the present invention may be combined as needed.

The present invention can be variously modified in the range not departing from the gist of the present invention, and it should be understood that the present invention encompasses the modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a housing in which an inlet port and an outlet port are formed;

a rotating shaft enclosed in the housing and supported rotatably;

spiral plates provided with at least one slit and disposed in a spiral form on an outer peripheral surface of the rotating shaft or of a rotating cylinder disposed on the rotating shaft;

a stator disc disposed in the slit of each of the spiral plates, with a predetermined space from the slit, and having solid portions forming a surface of the stator disc and hole portions penetrating the stator disc; and a spacer portion for fixing the stator disc; wherein gas sucked from the inlet port is transferred to the outlet port by an interaction between the spiral plates and the stator disc, the hole portions are provided in at least an outer peripheral region and an inner peripheral region of the stator disc, and an outer peripheral aperture ratio of the area of the hole portions in the outer peripheral region to the area of the solid portions in the outer peripheral region is higher than an inner peripheral aperture ratio of the area of the hole portions in the inner peripheral region to the area of the solid portions in the inner peripheral region, a ratio of the outer peripheral aperture ratio to the inner peripheral aperture ratio is between 2 to 9.

2. The vacuum pump according to claim 1, wherein the hole portions are circular holes having substantially the same diameter shape, and a larger number of the circular holes are provided in parallel in a predetermined region of the stator disc on an outer peripheral side than the number of the circular holes in a predetermined region of the stator disc on an inner peripheral side around a virtual center of the stator disc such that an aperture ratio in the stator disc on the outer peripheral side is higher than an aperture ratio in the stator disc on the inner peripheral side.

3. The vacuum pump according to claim 1, wherein the hole portions are circular holes having substantially the same diameter shape and a long hole having an elongated shape, and the circular holes are provided in a predetermined region of the stator disc on an inner peripheral side and the long hole is provided in a predetermined region of the stator disc on an outer peripheral in parallel in a radius direction such that an aperture ratio in the stator disc on the outer peripheral side is higher than an aperture ratio in the stator disc on the inner peripheral side.

4. A vacuum pump, comprising:

a housing in which an inlet port and an outlet port are formed;

a rotating shaft enclosed in the housing and supported rotatably;

spiral plates provided with at least one slit and disposed in a spiral form on an outer peripheral surface of the rotating shaft or of a rotating cylinder disposed on the rotating shaft;

a stator disc disposed in the slit of each of the spiral plates, with a predetermined space from the slit, and having solid portions forming a surface of the stator disc and hole portions penetrating the stator disc; and a spacer portion for fixing the stator disc; wherein gas sucked from the inlet port is transferred to the outlet port by an interaction between the spiral plates and the stator disc, the hole portions are provided in at least an outer peripheral region and an inner peripheral region of the stator disc, and an aperture ratio of the area of the hole portions in the outer peripheral region to the area of the solid portions in the outer peripheral region is higher than an aperture ratio of the area of the hole portions in the inner peripheral region to the area of the solid portions in the inner peripheral region, and the hole portions comprise a plurality of shaped holes, each shaped hole formed by an outer peripheral long hole portion having an elongated shape extending along a circumferential direction in the outer peripheral region of the stator disc and an inner peripheral long hole portion having an elongated shape extending along a radius direction from a solid portion of the stator disc within the inner peripheral region to the outer peripheral long hole portion so as to intersect the outer peripheral long hole portion at a position separated from both circumferential ends of the outer peripheral long hole portion, the inner peripheral long hole portion having a closed end defined by the solid portion of the stator disc within the inner peripheral region.

5. A vacuum pump, comprising:

a housing in which an inlet port and an outlet port are formed;

a rotating shaft enclosed in the housing and supported rotatably;

spiral plates provided with at least one slit and disposed in a spiral form on an outer peripheral surface of the rotating shaft or of a rotating cylinder disposed on the rotating shaft;

a stator disc disposed in the slit of each of the spiral plates, with a predetermined space from the slit, and having solid portions forming a surface of the stator disc and hole portions penetrating the stator disc; and a spacer portion for fixing the stator disc; wherein gas sucked from the inlet port is transferred to the outlet port by an interaction between the spiral plates and the stator disc, the hole portions are provided in at least an outer peripheral region and an inner peripheral region of the stator disc, and an aperture ratio of the area of the hole portions in the outer peripheral region to the area of the solid portions in the outer peripheral region is higher than an aperture ratio of the area of the hole portions in the inner peripheral region to the area of the solid portions in the inner peripheral region, the hole portions comprise a plurality of shaped holes, each shaped hole formed by linking an outer peripheral long hole having an elongated shape extending along a circumferential direction on an outer peripheral side of the stator disc and an inner peripheral long hole having an elongated shape extending along a radius direction on an inner peripheral side of the outer peripheral long hole so as to intersect the outer peripheral long hole at a circumferential end of the outer peripheral long hole, and the plurality of shaped holes are arranged in the stator disc in parallel in the circumferential direction such that an aperture ratio in the stator disc on the outer peripheral side is higher than an aperture ratio in the stator disc on the inner peripheral side.

6. The vacuum pump according to claim 5, wherein the inner peripheral long hole has a predetermined inclination angle with respect to the radius direction of the stator disc.

7. The vacuum pump according to claim 6, wherein the inclination angle is an angle determined such that a center of an inner peripheral solid portion surrounded by adjacent ones of the inner peripheral long holes and a center of an outer peripheral solid portion surrounded by adjacent ones of the outer peripheral long holes are aligned on a virtual straight line in the radius direction of the stator disc without the hole portions interposed therebetween.

8. The vacuum pump according to claim 1, wherein the stator disc is divided in a diameter direction at a position at which at least one of the hole portions disposed on an inner peripheral side is divided, and a gap is formed in a divided part of the divided hole portion on the inner peripheral side.

9. The vacuum pump according to claim 1, wherein a path of heat serving as a shortest route from an inner peripheral side to an outer peripheral side of the stator disc is formed in at least one location on the stator disc that does not include the hole portions.

* * * * *